US009752816B2

(12) United States Patent
Hwang et al.

(10) Patent No.: US 9,752,816 B2
(45) Date of Patent: Sep. 5, 2017

(54) INDOOR UNIT FOR AIR CONDITIONER

(71) Applicant: LG Electronics Inc., Seoul (KR)

(72) Inventors: Soonchul Hwang, Seoul (KR); Sanghyuk Son, Seoul (KR); Jaeyoung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 623 days.

(21) Appl. No.: 14/276,150

(22) Filed: May 13, 2014

(65) Prior Publication Data

US 2014/0345835 A1 Nov. 27, 2014

(30) Foreign Application Priority Data

May 24, 2013 (KR) ..... 10-2013-0059285

(51) Int. Cl.

| | |
|---|---|
| ***F24H 3/06*** | (2006.01) |
| ***F25D 17/06*** | (2006.01) |
| ***F04D 29/42*** | (2006.01) |
| ***F24F 13/28*** | (2006.01) |
| ***F24F 1/00*** | (2011.01) |

(52) U.S. Cl.

CPC ..... *F25D 17/06* (2013.01); *F04D 29/4253* (2013.01); *F24F 1/0007* (2013.01); *F24F 1/0011* (2013.01); *F24F 1/0022* (2013.01); *F24F 13/28* (2013.01)

(58) Field of Classification Search

CPC ..... F25D 17/06; F24F 1/0022; F24F 1/0011; F24F 1/0007; F04D 29/4253

USPC ..... 454/292, 239, 249, 318

See application file for complete search history.

(56) References Cited

U.S. PATENT DOCUMENTS

| | | | | |
|---|---|---|---|---|
| 6,168,517 | B1 * | 1/2001 | Cook | F24F 7/007 454/269 |
| 6,196,013 | B1 * | 3/2001 | Kim | F24F 1/027 62/262 |
| 7,163,374 | B2 * | 1/2007 | Lee | F04D 29/30 416/186 R |
| 7,752,862 | B2 * | 7/2010 | Bae | F24F 1/0007 165/122 |
| 2005/0044877 | A1 * | 3/2005 | Chin | F24F 1/0007 62/419 |

(Continued)

FOREIGN PATENT DOCUMENTS

| | | |
|---|---|---|
| CN | 1590856 A | 3/2005 |
| CN | 101631958 A | 1/2010 |

(Continued)

OTHER PUBLICATIONS

EP0477612A2—Machine English Translation.*

*Primary Examiner* — Etsub Berhanu
*Assistant Examiner* — Jose O Class-Quinones
(74) *Attorney, Agent, or Firm* — Dentons US LLP

(57) ABSTRACT

Provided is an indoor unit for an air conditioner. The indoor unit for the air conditioner includes a case having at least one suction hole, a heat exchanger disposed at a side of the suction hole, a fan rotatably disposed at a discharge side of the heat exchanger, a front panel coupled to a front portion of the case, the front panel including a discharge part, a discharge panel disposed on the discharge part, and a guide device disposed to surround the fan, the guide device having a curved surface for guiding air discharged from the fan to the guide part.

18 Claims, 11 Drawing Sheets

(56) References Cited

U.S. PATENT DOCUMENTS

| | | | | |
|---|---|---|---|---|
| 2005/0257561 | A1* | 11/2005 | Lee | F04D 33/00 62/419 |
| 2006/0162212 | A1* | 7/2006 | Kim | F24F 1/0007 40/725 |
| 2009/0098820 | A1* | 4/2009 | Yabu | F24F 1/0011 454/333 |
| 2009/0229289 | A1* | 9/2009 | Ohmae | F24F 1/0007 62/259.1 |
| 2010/0175411 | A1* | 7/2010 | Choi | F24F 1/0007 62/296 |
| 2010/0175418 | A1* | 7/2010 | Choi | F24F 1/0007 62/419 |
| 2011/0240255 | A1* | 10/2011 | Sakashita | F24F 1/0007 165/53 |
| 2012/0003917 | A1* | 1/2012 | Jeong | F24F 3/16 454/292 |
| 2012/0034862 | A1* | 2/2012 | Kim | F24F 1/0007 454/254 |

FOREIGN PATENT DOCUMENTS

| | | | | |
|---|---|---|---|---|
| CN | 102245975 | A | 11/2011 | |
| DE | EP 0477612 | A2 * | 4/1992 | F24F 1/0007 |
| EP | 1510762 | A1 | 2/2005 | |
| EP | 2378217 | A1 | 10/2011 | |
| GB | 2459063 | A | 10/2009 | |
| JP | 04-263715 | | 9/1992 | |
| JP | EP 1041351 | A1 * | 10/2000 | F24F 1/0007 |
| JP | 2006-138575 | | 6/2006 | |
| KR | WO 2007074952 | A2 * | 7/2007 | F24F 1/0007 |
| WO | 2008-126230 | A1 | 10/2008 | |

* cited by examiner

INDOOR UNIT FOR AIR CONDITIONER

CROSS-REFERENCE TO RELATED APPLICATIONS

The present application claims priority under 35 U.S.C. 119 and 35 U.S.C. 365 to Korean Patent Application No. 10-2013-0059285 (filed on May 24, 2013), which is hereby incorporated by reference in its entirety.

BACKGROUND

The present disclosure relates to an indoor unit for an air conditioner.

Air conditioners are home appliances that maintain air within a predetermined space into the most proper state according to use and purpose thereof. In general, such an air conditioner includes a compressor, a condenser, an expansion device, and evaporator. Thus, the air conditioner has a refrigerant cycle in which compression, condensation, expansion, and evaporation processes of a refrigerant are performed. Thus, the air conditioner may heat or cool a predetermined space.

The predetermined space may be variously provided according to a place at which the air conditioner is used. For example, when the air conditioner is disposed in a home or office, the predetermined space may be an indoor space of a house or building. On the other hand, when the air conditioner is disposed in a vehicle, the predetermined space may be a boarding space in which a person is boarded.

When the air conditioner performs a cooling operation, an outdoor heat exchanger provided in an outdoor unit may serve as a condenser, and an indoor heat exchanger provided in an indoor unit may serve as an evaporator. On the other hand, when the air conditioner performs a heating operation, the indoor heat exchanger may serve as the condenser, and the outdoor heat exchanger may serve as the evaporator.

FIG. 1 is a cross-sectional view of an indoor unit of an air conditioner according to a related art.

Referring to FIG. 1, an indoor unit 1 of an air conditioner according to a related art may include main bodies 2 and 3 including a main chassis 2 that forms an overall frame and defines an outer appearance of a back surface of the indoor unit 1 and a front frame 3 disposed at a front side of the main chassis 2 to define an outer appearance of a front surface of the indoor unit 1. A space for mounting a plurality of components is defined in the main bodies 2 and 3.

In detail, a suction hole 4 for suctioning indoor air into the main bodies 2 and 3 is defined in the indoor unit 1. The suction hole 4 may be provided in plurality in upper and lower portions of the front frame 3. Also, a suction grill for preventing a forging substance having a relatively large size from being introduced into the main bodies 2 and 3 may be disposed in the suction hole 4.

Also, a discharge hole 8 for discharging the air suctioned into the main bodies 2 and 3 may be disposed on a lower end of the front frame 3. A louver 9*a* and vane 9*b* for guiding a flow of air discharged through the discharge hole 8 are disposed in the discharge hole 8. The louver 9*a* and the vane 9*b* may be disposed to guide the discharged air in vertical and horizontal directions. Here, a motor for rotating the louver 9*a* and vane 9*b* may be connected to sides of the louver 9*a* and vane 9*b*.

A heat exchanger 6 in which indoor air and a refrigerant are heat-exchanged and a blower fan 7 for forcibly blowing the indoor air may be disposed within the main bodies 2 and 3.

The heat exchanger 6 may be disposed from a front end to a rear end of the inside of the main bodies 2 and 3 so that the indoor air suctioned into the main bodies 2 and 3 passes therethrough.

The blower fan 7 may be a tangential fan for allowing the air passing through the heat exchanger 6 to flow into the discharge hole 8 through the blower fan 7. In view of air flow, the blower fan 7 may be disposed on a rear end of the heat exchanger 6 and a front end of the discharge hole 8. Also, a motor for rotating the blower fan 7 may be connected to a side of the blower fan 7.

Also, a filter member (not shown) for filtering the indoor air may be disposed on a front end of the heat exchanger 6.

As described above, in the indoor unit according to the related art, the tangential fan is used to suction outdoor air. Although the tangential fan has an advantage in that less noise are generated, there is a disadvantage that the heat exchanger capable of covering an air passage has to be manufactured in large size.

That is, as shown in FIG. 1, it may be necessary that the heat exchanger is stepped to surround the tangential fan so as to the large heat exchanger is disposed within the main bodies of the indoor unit having a limited space. In this case, it may be difficult to manufacture the heat exchanger, and also, manufacturing costs of the heat exchanger may increase.

Also, when the tangential fan is used, a passage has to be precisely designed so as to generate a large mount of blowing air. In addition, when dusts are accumulated on the filter member, a differential pressure may increase to cause surging.

SUMMARY

Embodiments provide an indoor unit of an air conditioner, which is easily manufactured and is compact or slim.

In one embodiment, an indoor unit for an air conditioner includes: a case having at least one suction hole; a heat exchanger disposed at a side of the suction hole; a fan rotatably disposed at a discharge side of the heat exchanger; a front panel coupled to a front portion of the case, the front panel including a discharge part; a discharge panel disposed on the discharge part; and a guide device disposed to surround the fan, the guide device having a curved surface for guiding air discharged from the fan to the guide part.

The fan may suction the air in a rotation axis direction to discharge the air in a radius direction thereof.

The suction hole may include a rear suction hole for suctioning air from a rear side of the case and a side suction hole for suctioning air from a side of the case.

The discharge panel may be coupled to a front surface of the case, and the air suctioned through the suction hole may be discharged in a front side of the case through the discharge part.

The guide device may include: a first guide device including a suction hole for suctioning air into the fan and a bell mouth protruding along an edge of the suction hole; and a second guide device coupled to the first guide device, the second guide device having a first opening communicating with the suction hole and the curved surface extending from the first opening.

The second guide device may further include a ruled surface extending from the curved surface toward the discharge part, the ruled surface having a flat surface.

The first opening may have a size greater than that of the suction hole.

The second guide device may include a coupling part disposed on an edge of the first opening, the coupling part being coupled to an outer surface of the bell mouth of the first guide device.

The indoor unit may further include: a front panel coupled to the front portion of the case, the front panel having an opening; and a panel supporter supporting the discharge panel so that the discharge panel is disposed inside the opening.

The discharge part may be disposed in an outer region of the discharge panel in an entire region of the opening.

The discharge panel may include a guide protrusion protruding from the discharge panel toward the fan to guide the air to the discharge part.

The indoor unit may further include: a driving motor providing a driving force the fan; and a moving motor configured to allow the discharge panel to be movable in a front or rear direction of the case.

The indoor unit may further include: a motor shaft coupled to the moving motor; a pinion gear coupled to the motor shaft; and a rack gear interlocked with the pinion gear, the rack gear being coupled to the discharge panel.

The indoor unit may further include: a front panel coupled to the front portion of the case, the front panel being coupled to the discharge panel; and a moving guide protruding from the front panel to guide movement of the discharge panel in a front or rear direction.

The fan may include: a hub coupled to a driving motor; a shroud disposed to surround the hub; and a plurality of blades disposed between the hub and the shroud, the plurality of blades being disposed in a circumferential direction of the hub.

In another embodiment, an indoor unit for an air conditioner includes: a case having a suction hole for suctioning air from a rear side thereof; a heat exchanger disposed inside the suction hole; a fan including a plurality of blades that introduce the air passing through the heat exchanger in an axis direction thereof to discharge the air in a radius direction thereof; a front panel coupled to a front portion of the case, the front panel including a discharge part; a discharge panel disposed on the discharge part; a first guide device disposed between the fan and the heat exchanger, the first guide device having a suction hole for guiding inflow of air into the fan; and a second guide device having a curved surface, which converts a flow direction of the air discharged from the fan into a direction of the discharge part, and a ruled surface.

The second guide device may have a hemispherical shape.

The guide device may include: a first opening defining one end of the guide device to suction the air passing through the heat exchanger; and a second opening defining the other end of the guide device to discharge the air into the discharge part.

The second guide device may include a coupling part coupled to one surface of the first guide device, which is defined outside the suction hole.

The indoor unit may further include a moving motor for allowing the discharge panel to move in a front direction of the discharge part.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
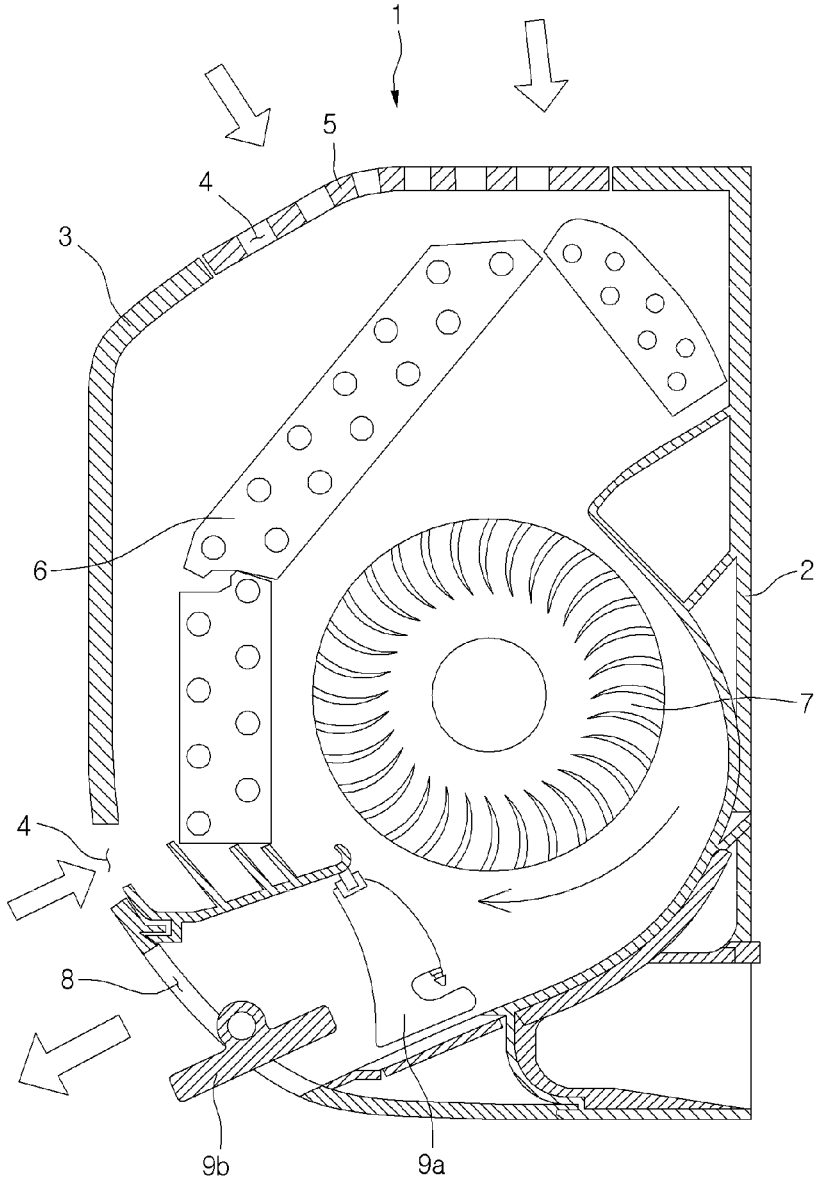
FIG. 1 is a cross-sectional view of an indoor unit of an air conditioner according to a related art.
Figure 2:
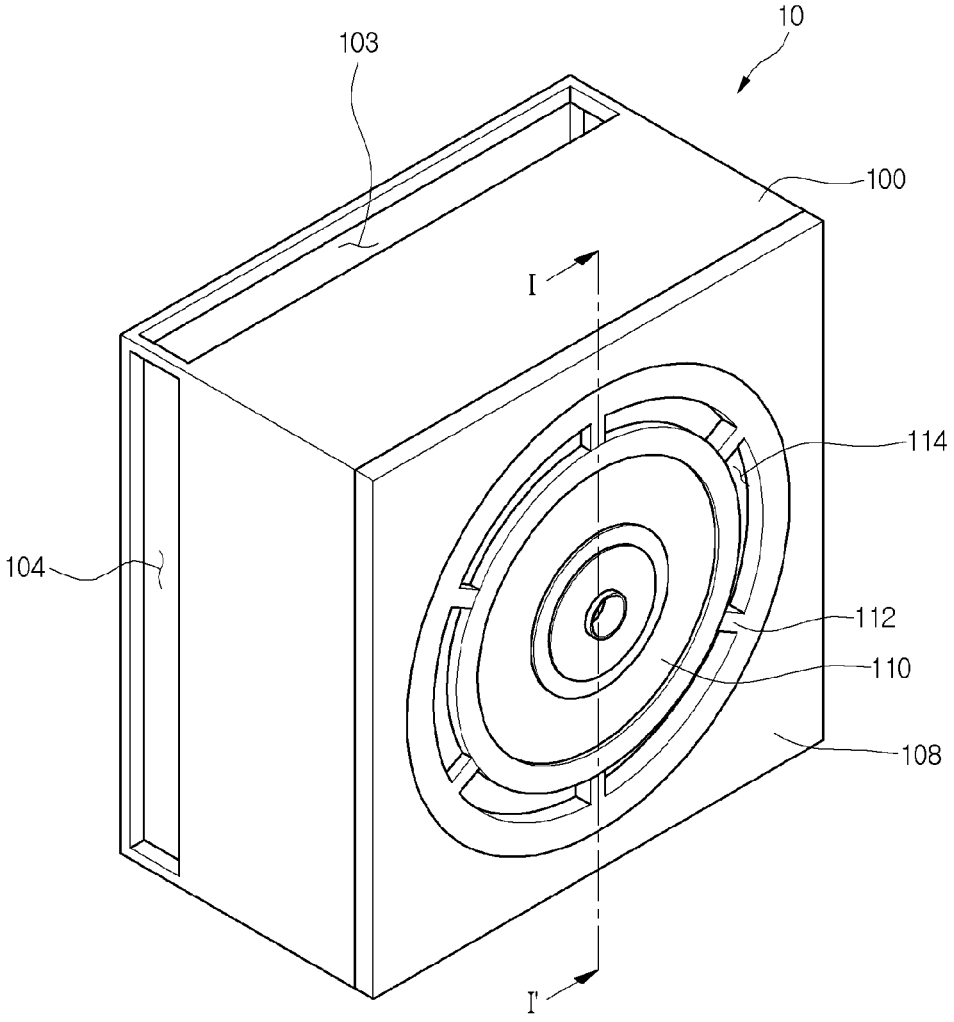
FIG. 2 is a perspective view of an indoor unit of an air conditioner according to a first embodiment.
Figure 3:
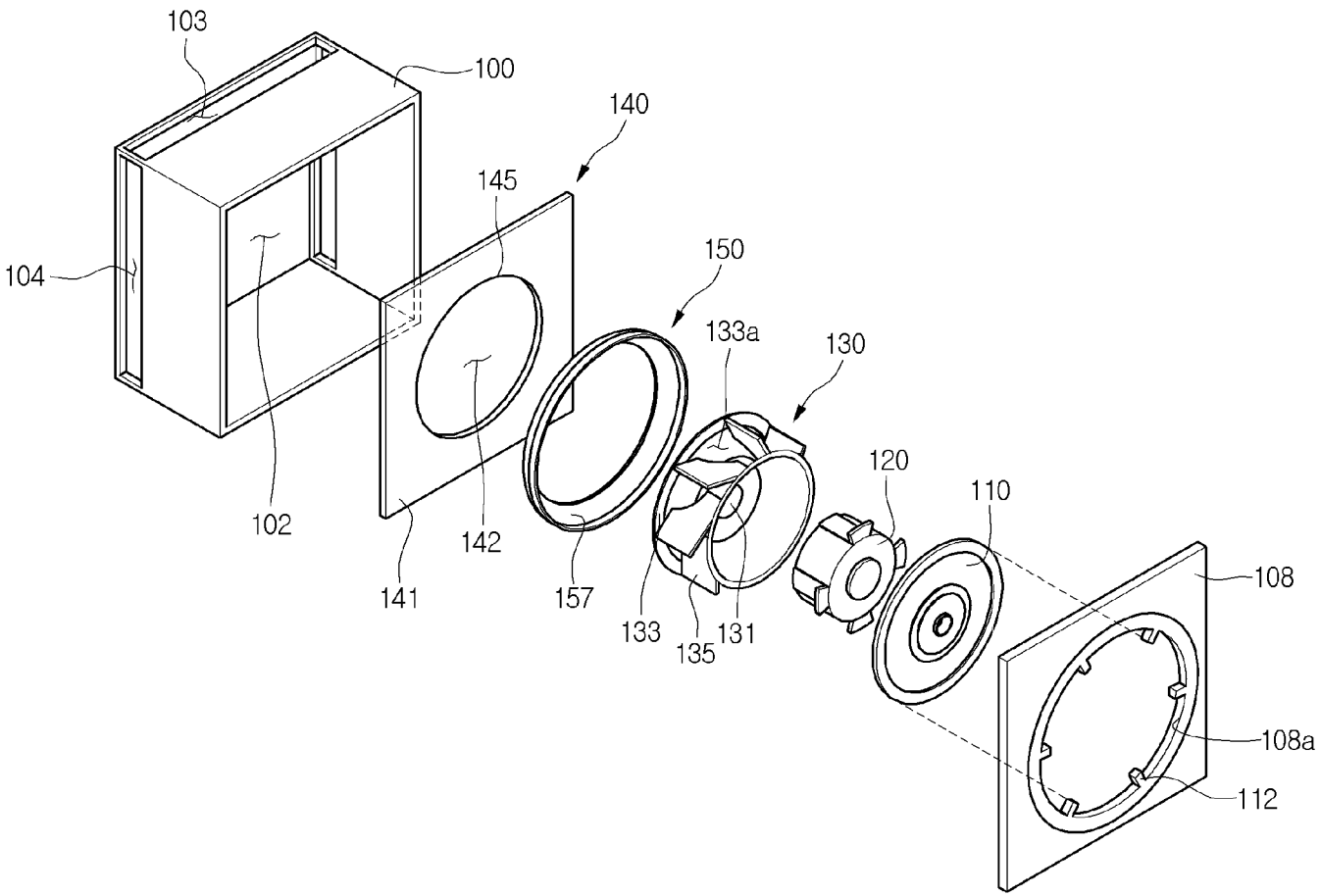
FIG. 3 is an exploded perspective view of the indoor unit of the air conditioner according to the first embodiment.

FIG. 2 is a perspective view of an indoor unit of an air conditioner according to a first embodiment, and FIG. 3 is an exploded perspective view of the indoor unit of the air conditioner according to the first embodiment. In FIG. 3, a heat exchanger is not illustrated.

Referring to FIGS. 2 and 3, an indoor unit 10 of an air conditioner according to a first embodiment includes a case 100 providing an air passage therein, a front panel 108 coupled to a front portion of the case 100, and a discharge panel 110 coupled to the front panel 108. In a board sense, the front panel 108 may be understood as one component of the case 100.

The case 100 has an approximately hexahedral shape having an empty inner space. For example, the case 100 may be installed on a wall of an indoor space. Here, a rear surface of the case 100 is coupled to the wall.

Hereinafter, in definition of directions, a "front direction" may represent a direction in which air is discharged into the indoor space, and a "rear direction" may represent a direction that is directed to the wall on which the indoor unit is installed.

A plurality of suction holes 102, 103, and 104 for suctioning indoor air are defined in the case 100. The plurality of suction holes 102, 103, and 104 include a rear suction hole 102 defined in a rear surface of the case 100, a top suction hole 103 defined in a top surface of the case 100, and a side suction hole 104 defined in a side surface of the case 100.

The plurality of suction holes 102, 103, and 104 may be defined by cutting at least one portion of the case 100. Also, the top suction hole 103 and the side suction hole 104 may be defined at a position adjacent to the rear surface of the case 100 than the top and side surfaces of the case 100.

The rear suction hole 102 may be defined in a direction that faces the wall on which the indoor unit 10 is installed. However, since a distance between the indoor unit 10 and the wall is shortened, a suction passage of air may not be formed into a sufficient size. Thus, since the top suction hole 103 and the side suction hole 104 are further provided, the indoor air may be easily suctioned into the case 100.

The front panel 108 may be coupled to a front portion of the case 100. The front panel 108 includes a panel opening 108*a* having an approximately circular shape and a plurality of panel supporters 112 coupled to the panel opening 108*a*.

The plurality of panel supporters 112 may be spaced apart from each other along a circumference of the panel opening 108*a*. The panel supporters 112 may be understood as members for fixing the discharge panel 110 to the front panel 108.

The discharge panel 110 may be disposed inside the panel opening 108*a*. Also, the discharge panel 110 may be fixed to a specific position by the plurality of panel supporters 112. Also, the discharge panel 110 has an approximately circular plate shape. The discharge panel 110 may have a size somewhat less than that of the panel opening 108*a*.

The indoor unit 10 includes a discharge part 114 for discharging the air. The discharge part 114 may be disposed in a space between the discharge panel 110 and the front panel 108. That is, the discharge part 114 may be disposed in an outer region of the discharge panel 110 of the entire region of the panel opening 108*a* as one region of the panel opening 108*a*.

On the other hand, the discharge panel 110 may block at least one of the air discharged through the panel opening 108*a* to guide the air to the outside of the discharge panel 110.

The air suctioned from the rear side of the case 100 may be discharged to a front side of the case 100 through the discharge part 114.

The indoor unit 10 includes a fan 130 disposed on a discharge side of the heat exchanger (see reference numeral 170 of FIG. 5), a driving motor 120 coupled to the fan 130, and a plurality of guide devices 140 and 150 guiding the air flowing by the rotation of the fan 130.

The driving motor 120 may be seated on the discharge panel 110. The discharge panel 110 includes a motor seat part 119 that is recessed so that the driving motor 120 is coupled thereto (see FIG. 5).

For example, the fan 130 may include a turbo fan that suctions the air in a rotation axis direction to discharge the air in a radius direction.

In detail, the fan 130 may include a hub 131 coupled to a motor shaft 122 of the driving motor 120, a shroud 133 disposed to surround the hub 131, and a plurality of blades 135 disposed between the hub 131 and the shroud 133 and disposed in a circumferential direction of the hub 131.

A first suction hole 133*a* for suctioning air is defined in the shroud 133. The air introduced through the first suction hole 133*a* may be discharged in a radial direction of the hub 131 along the blades 135.

The fan 130 is coupled to the plurality of guide devices 140 and 150 for guiding the air flow.

The plurality of guide devices 140 and 150 include a first guide device 140 having a second suction hole 142 communicating with the first suction hole 133*a*. The first guide device 140 is disposed between the fan 130 and the heat exchanger 170.

In detail, the first guide device 140 includes a first guide body 141 having an approximately plate shape and a bell mouth 145 disposed along a circumference of the second suction hole 142.

At least one portion of the second suction hole 142 may be opened at a central portion of the first guide body 141 and have an approximately circular shape. Also, the second suction hole 142 may have a size that corresponds to that of the first suction hole 133*a* of the shroud 133. In detail, the second suction hole 142 may be inserted into the first suction hole 133*a* and have a size slightly less than that of the first suction hole 133*a*.

Figure 5:
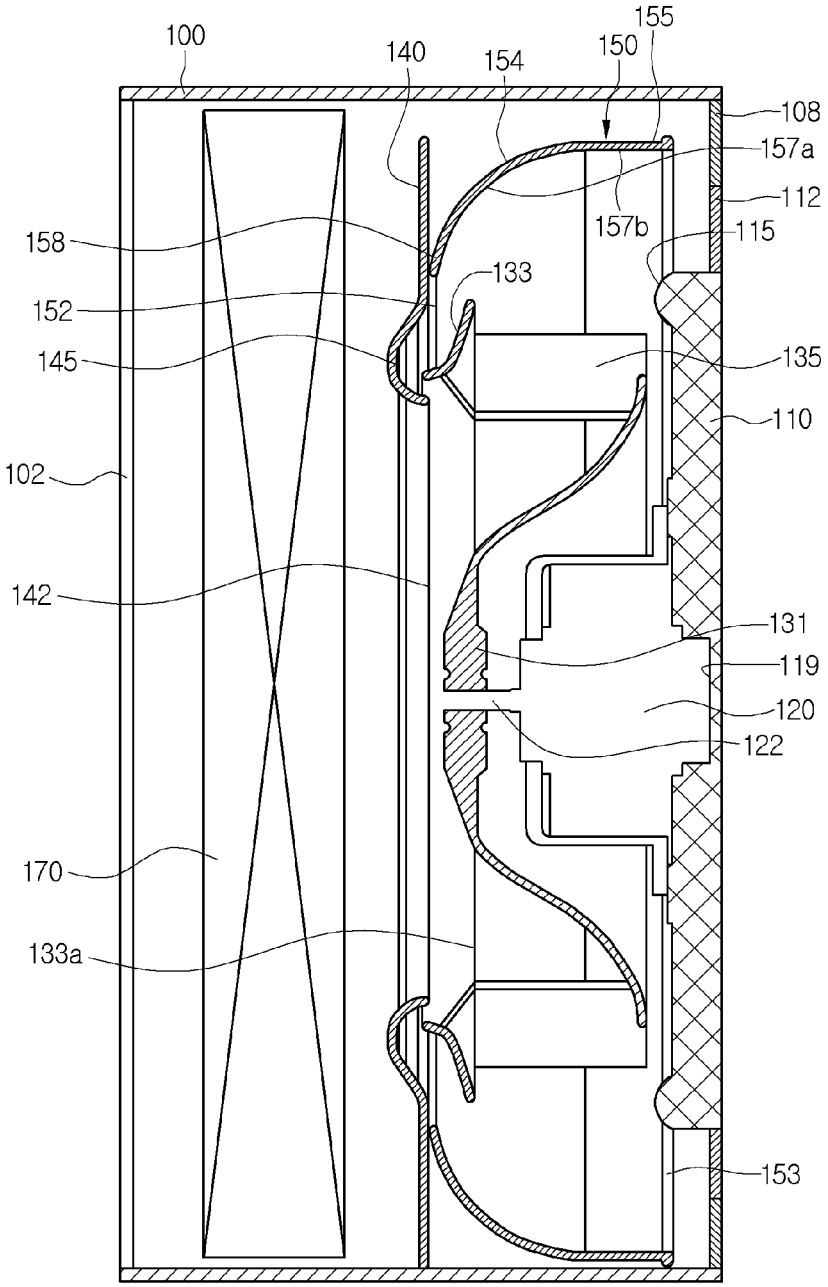
FIG. 5 is a cross-sectional view taken along line I-I' of FIG. 2.

The bell mouth 145 may protrude backward from the first guide body 141 toward the heat exchanger (see reference numeral 170 of FIG. 5). Also, the bell mouth 145 may have a rounded shape so that the air passing through the heat exchanger 170 is easily introduced into the second suction hole 142.

The plurality of guide devices 140 and 150 include a second guide device 150 coupled to a front portion of the first guide device 140 to guide the air passing through the fan 130 to the discharge part 114.

The second guide device 150 may be disposed to surround the fan 130, i.e., accommodate the fan 130 therein. The second guide device 150 may be separably coupled to the first guide device 140.

Also, a guide surface 157 having at least rounded surface to guide the air flow may be disposed on an inner surface of the second guide device 150. Hereinafter, the second guide device 150 will be described with reference to the accompanying drawings.

Figure 4:
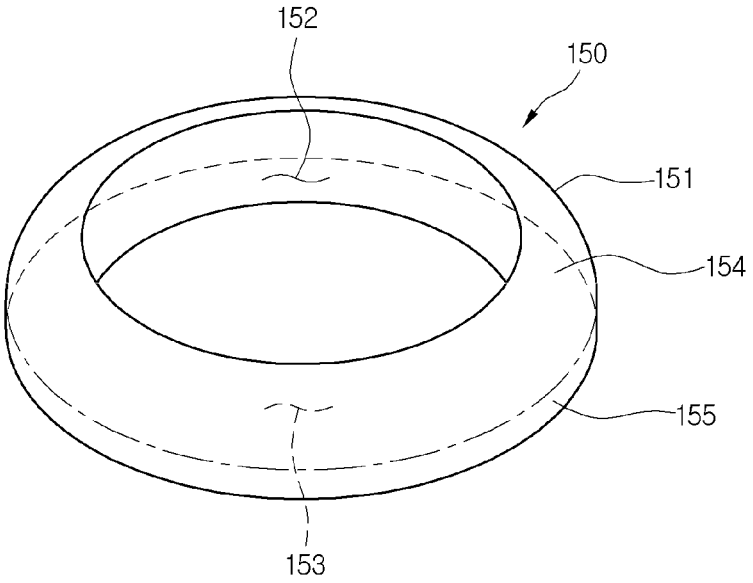
FIG. 4 is a view of a second guide device according to the first embodiment.

FIG. 4 is a view of the second guide device according to the first embodiment, and FIG. 5 is a cross-sectional view taken along line I-I' of FIG. 2.

Referring to FIGS. 4 and 5, the second guide device 150 according to the first embodiment includes a second guide body 151 having an approximately hemispherical shape, and a first opening 152 defined in one end of the second guide body 151 to suction air, and a second opening 153 defined in the other end of the second guide body 151 to discharge air.

The first opening 152 may communicate with the second suction hole 142 of the first guide device 140. The first opening 152 may be called a "suction opening", and the second opening 153 may be called a "discharge opening".

The fan 130 may be disposed inside the second guide body 151. Thus, a "discharge passage" for guiding a flow of the air passing through the fan 130 may be defined in the second guide body 151.

The first opening 152 may have a size less than that of the first suction hole 133*a* of the shroud 133. Also, the first opening 152 may have a size greater than that of the second suction hole 142 of the first guide device 140.

A coupling part 158 coupled to a front surface of the first guide body 141 is disposed on the second guide body 151. The coupling part 158 may be understood as an edge part of the first opening 152.

In detail, referring to FIG. 5, the coupling part 158 may be coupled to a portion of a front surface of the first guide body 141 that is defined outside the bell mouth 145. Since the second guide body 151 is coupled to the first guide body 141, it may prevent air from leaking through a space between the first guide body 141 and the second guide body 151. That is, an sealing effect may be achieved.

The second guide body 151 has a curved surface 154 that is rounded to extend from the first opening 152 at a predetermined curvature and a ruled surface 155 extending forward from the curved surface 154 and having a flat plane. That is, the ruled surface 155 may extend from the curved surface 154 toward the discharge part 114.

Guide surfaces 157*a* and 157*b* for guiding an air flow are defined on an inner surface of the second guide body 151. The guide surfaces 157*a* and 157*b* include a first guide surface 157*a* defined an inner surface of the curved surface 154 and a second guide surface 157*b* defined on an inner surface of the ruled surface 155.

The first guide surface 157*a* may be a surface that is rounded to correspond to a shape of the curved surface 154, and the second guide surface 157*b* may be a flat surface that corresponds to a shape of the ruled surface 155.

According to the above-described constitutions, the air discharged in the radial direction of the fan 130 after passing through the fan 130 may be guided along the first and second guide surfaces 157*a* and 157*b* and thus be easily discharged forward toward the discharge part 114.

A guide protrusion 115 may be disposed on an edge of the discharge panel 110. The guide protrusion 115 may protrude backward from the discharge panel 110, i.e., toward the fan 130 and have a rounded surface.

Since the guide protrusion 115 is provided, the air passing through the fan 130 may be easily guided forward along the rounded surface of the guide protrusion 115. Here, the air may flow to the discharge part 114 via a space of the second opening 153 of the second guide device 150 that is defined outside the discharge panel 110.

The heat exchanger 170 is disposed inside the case 100. The heat exchanger 170 is disposed between the rear suction hole 102 and the fan 130. Thus, the air suctioned into the rear suction hole 102 or the plurality of suction holes 103 and 104 may pass through the fan 130 after passing through the heat exchanger 170.

Figure 6:
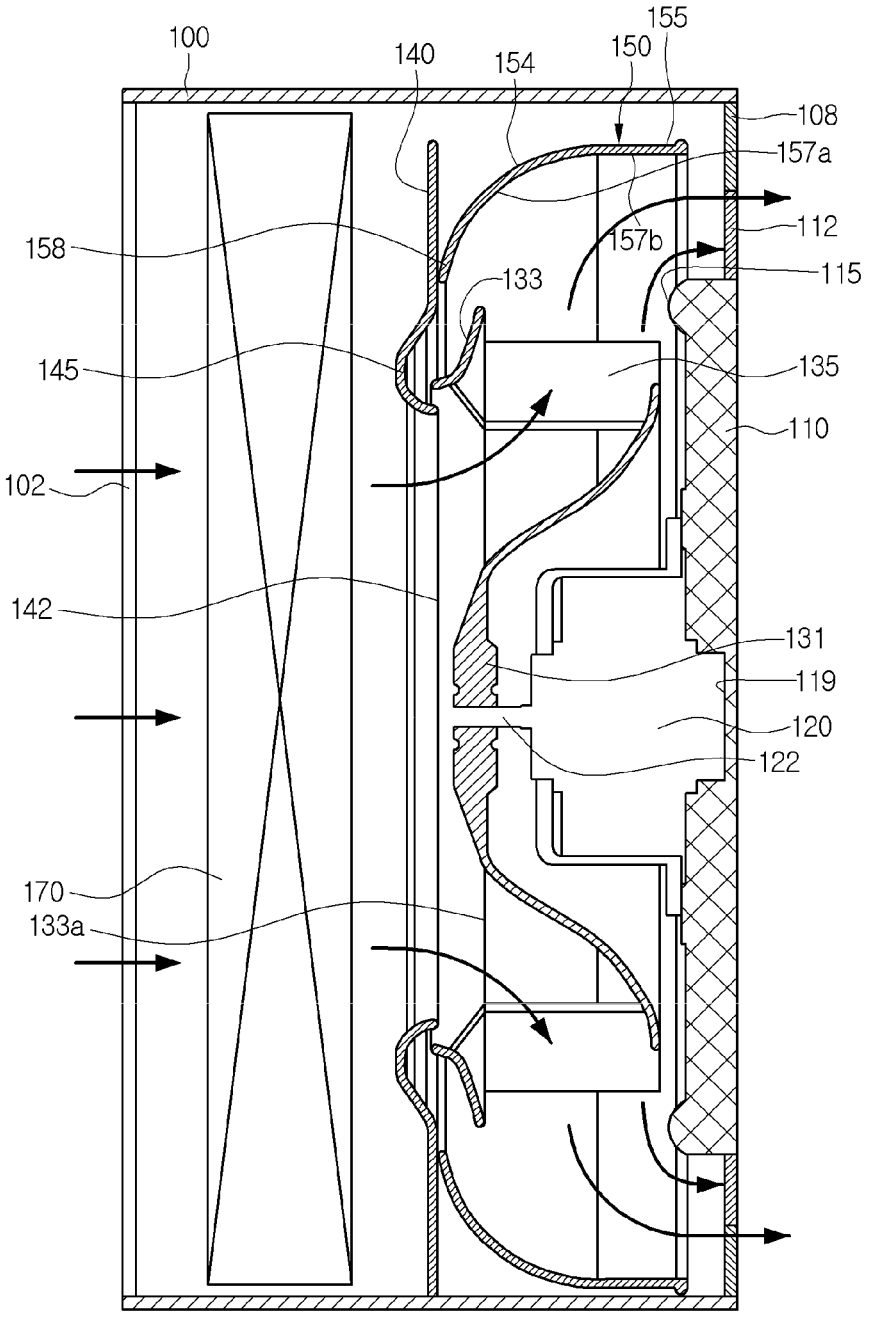
FIG. 6 is a view of an air flow in an indoor unit according to the first embodiment.

FIG. 6 is a view of an air flow in an indoor unit according to the first embodiment. Referring to FIG. 6, an air flow according to the current embodiment will be simply described.

When the driving motor 120 operates, air is suctioned while the fan 130 rotates. While the fan 130 rotates, the hub 131, the shroud 133, and the plurality of blades 135 which are connected to the motor shaft 122 may integrally rotate.

When the suction force is generated, air is suctioned through the plurality of suction holes 102, 103, and 104 from a rear side of the case 100. The suctioned air may flow forward after passing through the heat exchanger 170 and then be introduced in an axis direction of the fan 130. Here, the "axis direction" may be understood as a direction in which the motor shaft 122 extends.

Here, the air may be introduced into the shroud 133 through inner spaces of the second suction hole 142 of the first guide device 140, the first opening 152 of the second guide device 150, and the first suction hole 144*a* of the shroud 133.

The air introduced into the shroud 133 may be guided by the plurality of rotating blades and then discharged in the rotation radius direction of the fan 130. That is, a flow direction of the air suctioned from a rear side in a direction of a rotation center axis of the fan 130 may be converted into an approximately vertical direction (radius direction). Thus, the air flows into upper and lower sides of the fan 130.

Also, the air discharged from the fan 130 may be guided forward through the guide surface 157 of the first guide device 150.

Here, since the guide surface 157 includes the rounded first guide surface 157*a* and the second guide surface 157*b* that flatly extends forward, the air flow may be effectively guided. Also, air flowing along the edge of the discharge panel 110 may be easily guided forward along the rounded surface of the guide protrusion 115.

Hereinafter, a description will be made according to a second embodiment. Since the current embodiment is the same as the first embodiment except for portions of the constitutions, different parts between the first and second embodiments will be described principally, and descriptions of the same parts will be denoted by the same reference numerals and descriptions of the first embodiment.

Figure 7:
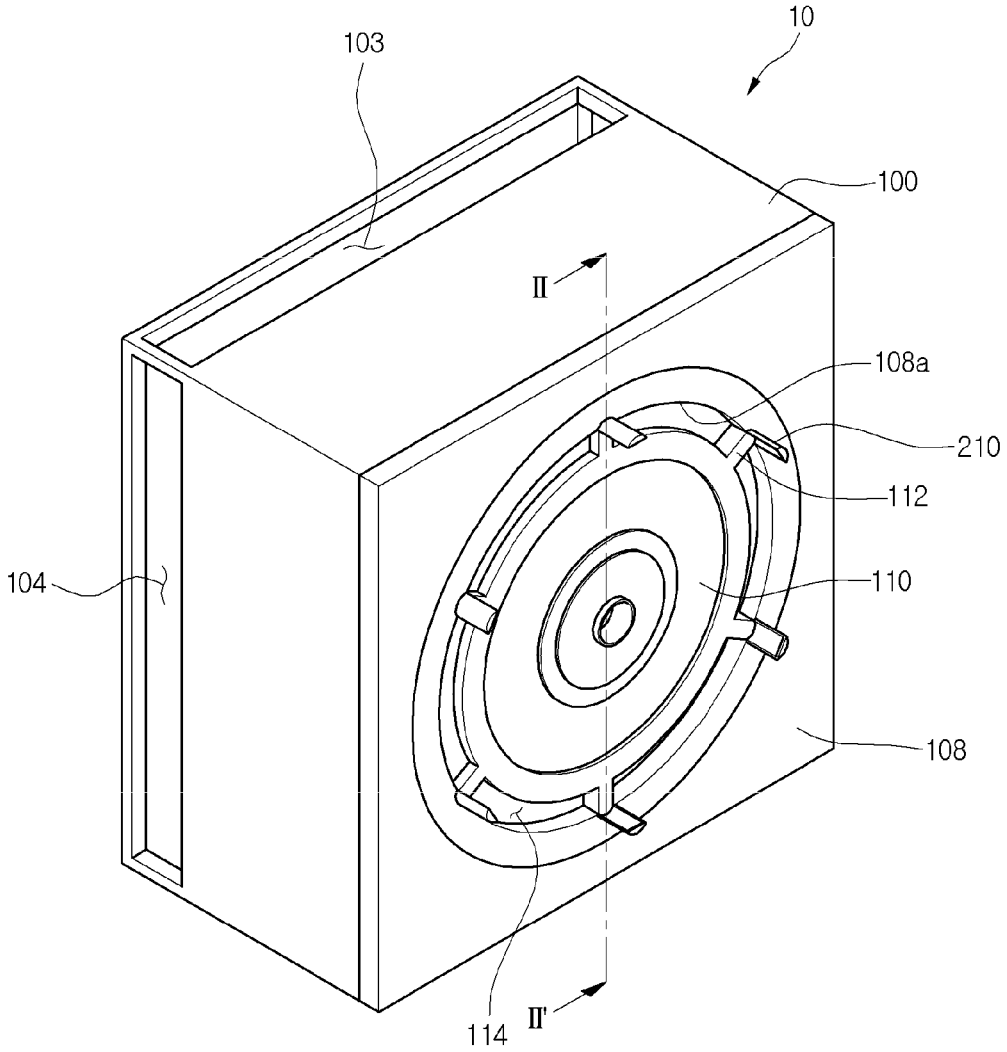
FIG. 7 is a perspective view of an indoor unit of an air conditioner according to a second embodiment.
Figure 8:
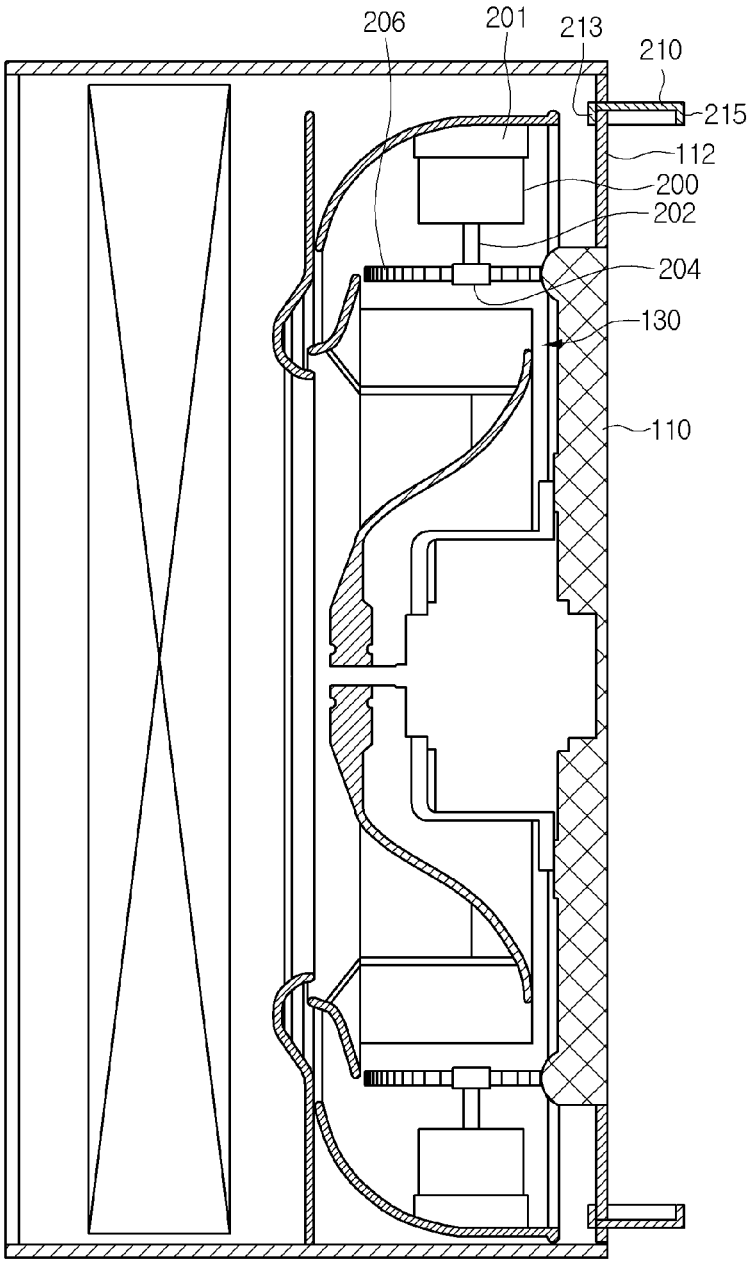
FIG. 8 is a cross-sectional view taken along line II-II' of FIG. 7.
Figure 9:
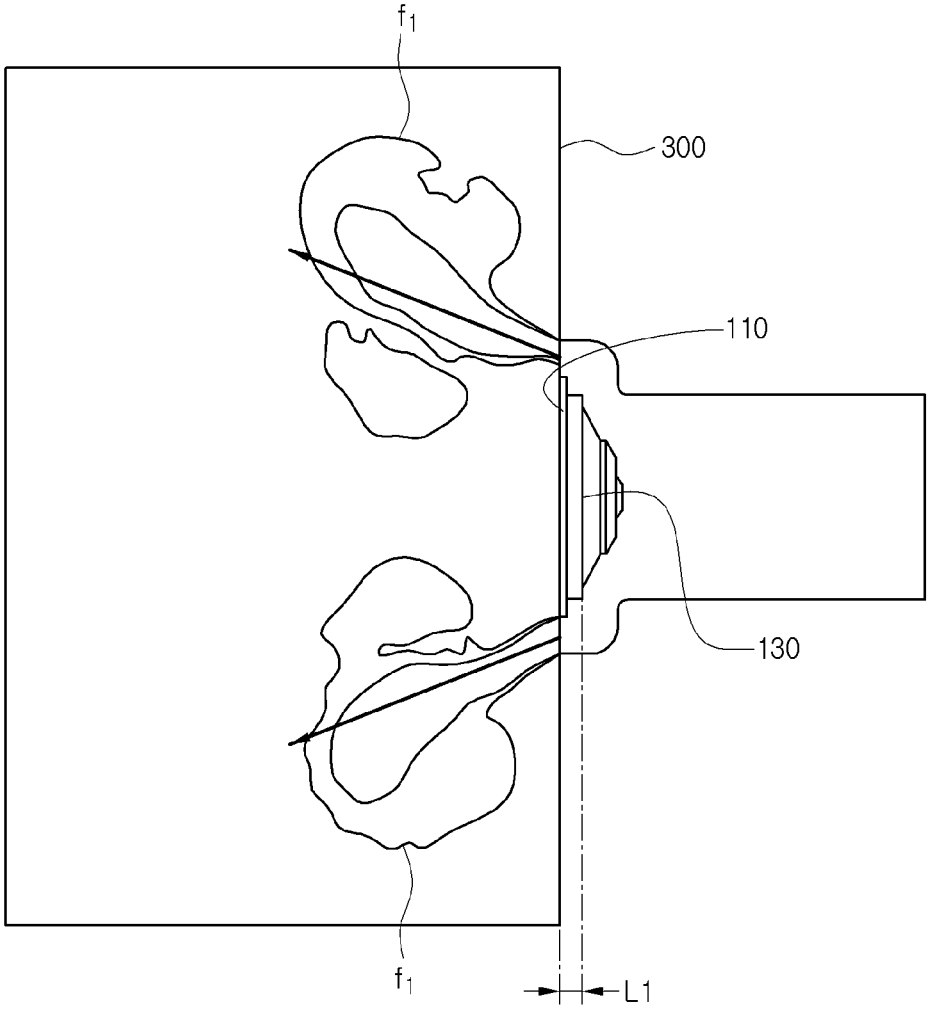
FIG. 9 is a view illustrating a simulation of air discharge when a discharge panel is disposed at one position according to the second embodiment.
Figure 10:
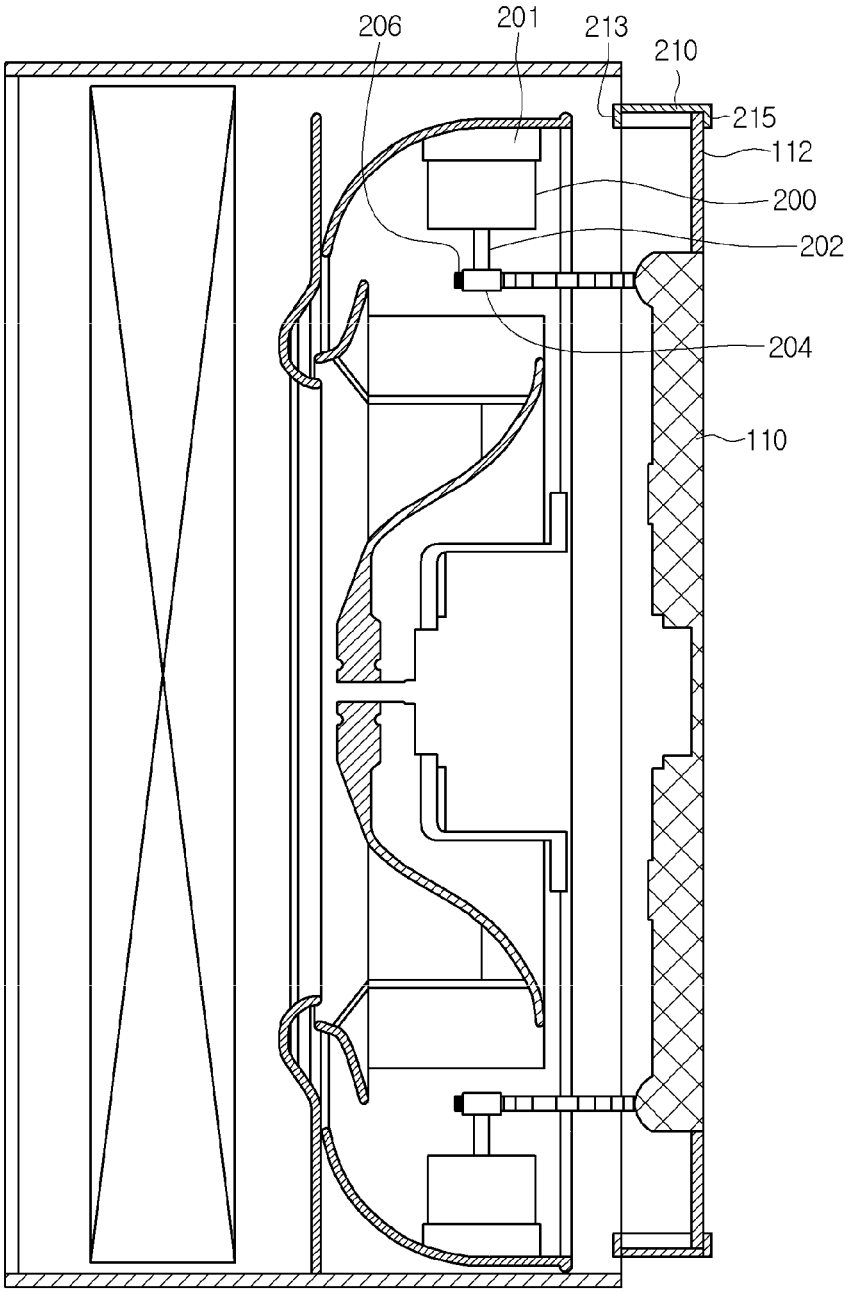
FIG. 10 is a cross-sectional view of an indoor unit when the discharge panel is disposed at the other position according to the second embodiment.
Figure 11:
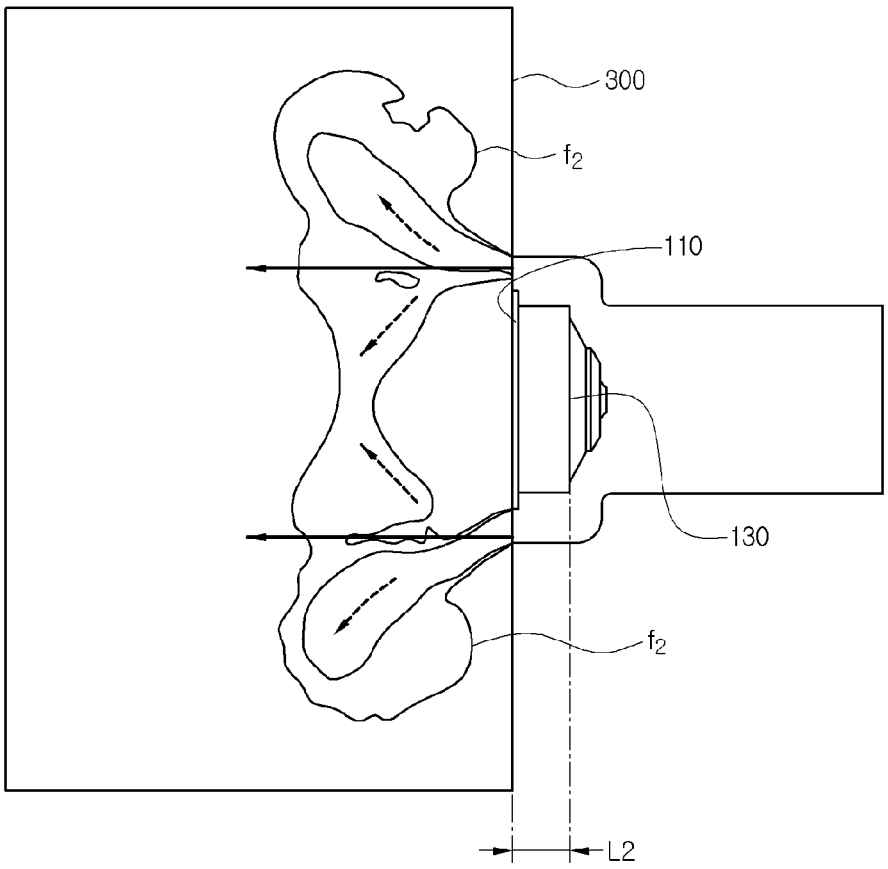
FIG. 11 is a view illustrating a simulation of air discharge when the discharge panel is disposed at the other position according to the second embodiment.

FIG. 7 is a perspective view of an indoor unit of an air conditioner according to a second embodiment, FIG. 8 is a cross-sectional view taken along line II-II' of FIG. 7, FIG. 9 is a view illustrating a simulation of air discharge when a discharge panel is disposed at one position according to the second embodiment, FIG. 10 is a cross-sectional view of an indoor unit when the discharge panel is disposed at the other position according to the second embodiment, and FIG. 11 is a view illustrating a simulation of air discharge when the discharge panel is disposed at the other position according to the second embodiment.

Referring to FIGS. 7 and 8, an indoor unit 10 of an air conditioner according to a second embodiment includes a front panel 108 having a panel opening 108*a*, a discharge panel 110 movable forward or backward in the panel opening 108*a*, and a moving guide 210 guiding movement of the discharge panel 110.

A discharge part 114 is disposed between the panel opening 108*a* and the discharge panel 110. The discharge panel 110 may cover a front side of the panel opening 108*a*. Here, a space that is not covered may function as the discharge part 114. The discharge part 114 may vary in size according to a position of the discharge panel 110.

For example, the discharge panel 110 may be linearly movable. When the discharge panel 110 moves, the discharge part 114 may vary in size (discharge region).

Also, the discharge panel 110 includes a panel supporter 112 that is movable forward or backward. The panel supporter 112 may move in a state where the panel supporter 112 is supported by the moving guide 210.

In detail, the moving guide 210 may have a shape that is recessed to accommodate an end of the panel supporter 112. For example, the moving guide 210 may have a cross section having a semicircular shape.

The moving guide 210 may be provided in plurality along an edge of the panel opening 108*a* of the front panel 108. The plurality of moving guides 210 may be spaced apart from each other and protrude forward from the front panel 108.

When the discharge panel 110 moves forward, the panel supporter 112 may be disposed at a front portion of the moving guide 108 (see FIG. 10). Also, when the discharge panel is inserted into a rear side, the panel supporter 112 may be disposed at a rear end of the moving guide 108 (see FIG. 8).

A first stopper 213 that interferes with the panel supporter 112 in the state where the discharge panel 110 moves backward is disposed on a rear end of the moving guide 210. When the panel supporter 112 interferes with the first stopper 213, the backward movement of the discharge panel 110 may be restricted. Thus, it may prevent the discharge panel 110 and the panel supporter 112 from being separated backward from the front panel 108.

A second stopper 215 that interferes with the panel supporter 112 in the state where the front panel 108 moves forward is disposed on a front end of the moving guide 210. When the panel supporter 112 interferes with the second stopper 215, the forward movement of the discharge panel 110 may be restricted. Thus, it may prevent the discharge panel 110 and the panel supporter 112 from being separated forward from the front panel 108.

A driving device for moving the discharge panel 110 is disposed within the case 100. The driving device may be provided on each of upper and lower portions of the case 100.

In detail, the driving device may include a moving motor 200 for generating a driving force and a power transmission for transmitting the driving force of the moving motor 200 to the discharge panel 110.

The power transmission includes a pinion gear 204 coupled to a motor shaft 202 of the moving motor 200 and a rack gear 206 interlocked with the pinion gear 204 and coupled to the discharge panel 110.

The moving motor 200 is supported by a motor support 201. The motor support 201 may be mounted on an inner surface of the second guide device 150. Also, the motor shaft 202 may vertically extend from the moving motor 200. While the moving motor 200 operates, the pinion gear 204 may rotate together with the motor shaft 202.

The rack gear 206 may be coupled to a rear surface of the discharge panel 110 to extend backward. When the pinion gear 204 rotates, the rack gear 206 may move forward or backward. When the rack gear 206 moves, the discharge panel 110 coupled to the rack gear 206 may move together with the panel supporter 112 along the moving guide 210.

Referring to FIG. 8, in the state where the front surface of the discharge panel 110 moves backward so that the front surface of the discharge panel 110 has approximately the same surface as that of the front panel 108, the panel supporter 112 may be supported by the first stopper 213 of the moving guide 210.

Here, a spaced distance from the discharge panel 110 to the fan 130 may be a distance L1.

In this state, when the fan 130 operates, as shown in FIG. 9, air may pass through the fan 130 and then be discharged forward along the second guide device 150. The current of the discharged air may generate an air flow f1.

Here, since the distance L1 has a relatively small valve, that is, since a distance between the discharge panel 110 and the fan 130 is relatively less, air may be concentrated into both front sides of the indoor unit 10 of the air conditioner and then be discharged.

On the other hand, when the moving motor 200 operates in the state of FIG. 8, the pinion gear 204 may rotate, and thus, the rack gear 206 interlocked with the pinion gear 204 may move forward. As the rack gear 206 moves, as shown in FIG. 10, the discharge panel 110 may move forward and be disposed at a front side of the front panel 108.

Here, a spaced distance from the discharge panel 110 to the fan 130 may be a distance L2. The distance L2 may be greater than the distance L1.

In this state, when the fan 130 operates, as shown in FIG. 11, air may pass through the fan 130 and then be discharged forward along the second guide device 150. The current of the discharged air may generate an air flow f2.

Here, since the distance L2 has a relatively large valve, that is, since a distance between the discharge panel 110 and the fan 130 is relatively large, air may be spread while passing through the discharge panel 110. Therefore, the air may be uniformly discharged in both front side and center directions of the indoor unit 10.

In the state of FIG. 9, the discharge mode of the indoor unit may be a "concentration wind mode" for concentrating the air in a specific direction. Also, in the state of FIG. 11, the discharge mode of the indoor unit may be a "spreading wind mode" for uniformly spreading the air into all directions within the indoor unit.

As described above, since the discharge panel is movable forward or backward, the air discharge direction may be controlled according to the operation mode of the indoor unit. Therefore, the indoor unit may be improved in reliability and also increase in use convenience.

According to the embodiments, the turbo fan may be used in the wall mount-type indoor unit to realize the compact and slim indoor unit and the reliable passage design.

Also, since the guide device is provided in the indoor unit to guide the air flowing in the radius direction of the turbo fan into the front side of the indoor unit, the air may be effectively discharged into the indoor space.

Also, since the sufficient amount of air is secured even through a heat exchanger having a relatively small size is used in the inlet side of the turbo fan, manufacturing costs may be reduced.

Also, since the movable discharge panel is provided at the front side of the case of the indoor unit, the air discharge direction may be easily controlled according to the operation mode of the indoor unit.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor unit for an air conditioner, the indoor unit comprising:

a case having at least one suction part;

a heat exchanger disposed in the case;

a fan disposed between the heat exchanger and a front portion of the case;

a front panel disposed at the front portion of the case, the front panel comprising a panel opening;

a discharge panel disposed at the panel opening, and a discharge part disposed between the front panel and the discharge panel;

a guide device disposed to surround the fan and having a curved surface for guiding air discharged from the fan to the discharge part;

a panel supporter supporting the discharge panel so that the discharge panel is disposed within the opening; and a moving guide protruding from the front panel to guide movement of the discharge panel in a front or rear direction of the case, wherein at a rear end of the moving guide is disposed a first stopper that interferes with the panel supporter in a state where the discharge panel moves backward, and at a front end of the moving guide is disposed a second stopper that interferes with the panel supporter in a state where the front panel moves forward.

2. The indoor unit according to claim 1, wherein the fan suctions the air in a rotation axis direction of the fan and discharges the air in a radial direction thereof.

3. The indoor unit according to claim 1, wherein the suction part comprises at least one of a rear suction hole for suctioning the air from a rear side of the case and a side suction hole for suctioning the air from a side of the case.

4. The indoor unit according to claim 1, wherein the fan comprises:

a hub;

a shroud disposed to surround the hub;

a plurality of blades disposed between the hub and the shroud and disposed in a circumferential direction of the hub; and a first suction hole disposed at the shroud.

5. The indoor unit according to claim 4, wherein the guide device comprises:

a first guide device comprising a second suction hole communicating with the first suction hole of the fan and a bell mouth protruding along an edge of the second suction hole; and a second guide device including a first opening communicating with the second suction hole of the first guide device, and the curved surface extending from the first opening to surround the fan.

6. The indoor unit according to claim 5, wherein the second guide device further comprises a ruled surface extending linearly from an edge of the curved surface toward the discharge part.

7. The indoor unit according to claim 5, wherein the first opening of the second guide device has a size greater than that of the second suction hole of the first guide device.

8. The indoor unit according to claim 7, wherein the second guide device comprises a coupling part at an edge of the first opening, the coupling part contacting a surface of the first guide device to prevent the air from leaking between the first guide device and the second guide device.

9. The indoor unit according to claim 1, wherein the discharge part is disposed in an outer region of the discharge panel and in an entire region of the panel opening.

10. The indoor unit according to claim 1, wherein the discharge panel comprises a guide protrusion protruding from the discharge panel toward the fan to guide the air to the discharge part.

11. The indoor unit according to claim 1, further comprising:

a driving motor providing a driving force to the fan; and a moving motor allowing the discharge panel to be movable in the front or rear direction of the case.

12. The indoor unit according to claim 11, further comprising:

a motor shaft coupled to the moving motor;

a pinion gear coupled to the motor shaft; and a rack gear interlocked with the pinion gear, the rack gear coupled to the discharge panel.

13. An indoor unit for an air conditioner, the indoor unit comprising:

a case having a suction part for suctioning air from a rear portion thereof;

a heat exchanger disposed in the case;

a fan comprising a plurality of blades that suctions the air to pass through the heat exchanger in an axis direction of the fan and discharge the air in a radial direction thereof;

a front panel disposed at a front portion of the case and having a panel opening;

a discharge panel disposed at the panel opening, and a discharge part disposed between the front panel and the discharge panel;

a first guide device disposed between the fan and the heat exchanger and having a second suction hole for guiding inflow of the air into the fan; and a second guide device having a curved portion and a ruled portion, which directs a flow direction of the air discharged from the fan towards the discharge part, wherein the second guide device comprises:

a first guide surface formed on an inner surface of the curved portion extending roundly from a rear portion of the fan toward a front portion of the fan; and a second guide surface formed on an inner surface of the ruled portion extending in an axial direction from the curved surface toward the discharge part, wherein the air discharged in the radial direction of the fan is discharged toward the front portion of the case through the discharge part along the first guide surface and the second guide surface.

14. The indoor unit according to claim 13, wherein the second guide device comprises a hemispherical shape.

15. The indoor unit according to claim 13, wherein the second guide device comprises a coupling part contacting one surface of the first guide device, which is defined outside the second suction hole of the first guide device.

16. The indoor unit according to claim 13, wherein the fan comprises:

a hub;

a shroud disposed to surround the hub;

the plurality of blades disposed between the hub and the shroud and disposed in a circumferential direction of the hub; and a first suction hole disposed in the shroud.

17. The indoor unit according to claim 13, wherein the discharge panel is movable in a front or rear direction of the case so that the discharge part varies in size according to a position of the discharge panel with respect to the case.

18. The indoor unit according to claim 17, further comprising a moving motor for allowing the discharge panel to move.

* * * * *